US008763857B2

(12) United States Patent
Middleton

(10) Patent No.: US 8,763,857 B2
(45) **Date of Patent: *Jul. 1, 2014**

(54) LIQUID DISPENSING SYSTEMS

(71) Applicant: Boxxle, LLC, Greensboro, NC (US)

(72) Inventor: Tripp Middleton, Greensboro, NC (US)

(73) Assignee: Boxxle, LLC, Greensboro, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/874,612

(22) Filed: May 1, 2013

(65) Prior Publication Data

US 2013/0240562 A1 Sep. 19, 2013

Related U.S. Application Data

(63) Continuation-in-part of application No. 13/858,171, filed on Apr. 8, 2013, which is a continuation of application No. PCT/US2011/055776, filed on Oct. 11, 2011.

(60) Provisional application No. 61/392,268, filed on Oct. 12, 2010.

(51) Int. Cl.

| | |
|---|---|
| ***B65D 35/28*** | (2006.01) |
| ***B65D 35/56*** | (2006.01) |
| ***B67D 1/00*** | (2006.01) |
| ***B65D 83/00*** | (2006.01) |
| ***B67D 3/00*** | (2006.01) |
| ***B67D 1/08*** | (2006.01) |
| ***B65D 35/30*** | (2006.01) |

(52) U.S. Cl.

CPC ..... *B65D 35/30* (2013.01); *B67D 2210/00031* (2013.01); *B67D 1/0001* (2013.01); *B65D 83/0077* (2013.01); *B67D 3/00* (2013.01); *B67D 2001/0096* (2013.01); *B67D 1/0891* (2013.01); *B67D 2001/0827* (2013.01)

USPC ..... 222/95; 222/103; 222/105

(58) Field of Classification Search

USPC ..... 222/103, 95, 105, 340, 386.5, 153.01, 222/153.04, 153.14, 153.13, 130, 131, 183, 222/146.1, 146.2, 146.5, 146.6

See application file for complete search history.

(56) References Cited

U.S. PATENT DOCUMENTS

| | | | | |
|---|---|---|---|---|
| 4,722,457 | A * | 2/1988 | Bedwell et al. | 222/103 |
| 5,096,092 | A * | 3/1992 | Devine | 222/95 |
| 5,685,456 | A * | 11/1997 | Goldstein | 222/95 |
| 6,062,426 | A * | 5/2000 | Bartholmey et al. | 222/1 |
| 6,223,944 | B1 * | 5/2001 | Gehl et al. | 222/94 |
| 7,182,222 | B2 * | 2/2007 | Prabucki | 222/146.6 |

(Continued)

OTHER PUBLICATIONS

Middleton, "Liquid Dispensing Systems", U.S. Appl. No. 13/858,171, filed Apr. 8, 2013.

*Primary Examiner* — Paul R Durand
*Assistant Examiner* — Benjamin R Shaw
(74) *Attorney, Agent, or Firm* — Keating & Bennett, LLP

(57) ABSTRACT

A liquid dispensing system for use with a bag having a pre-attached spigot includes a cavity arranged to receive the bag of liquid. A spigot-recess is configured to engage the spigot of the bag of liquid. A top plate assembly is locatable at or near the top of the system, the top plate assembly including a pressure plate arranged to apply a downward force on the bag of liquid. The system also includes a lifting plate arranged to apply an upward pressure on the bag of liquid.

16 Claims, 20 Drawing Sheets

(56) References Cited

U.S. PATENT DOCUMENTS

2007/0138202 A1* 6/2007 Evers ..... 222/95
2009/0120956 A1* 5/2009 De La Fe Dahlin ..... 222/95
2010/0206901 A1* 8/2010 Alguera Gallego et al. .... 222/95

* cited by examiner

LIQUID DISPENSING SYSTEMS

BACKGROUND OF THE INVENTION

1. Field of the Invention

The present invention relates generally to liquid dispensing systems, and more particularly to dispensing systems that receive and dispense liquid contained in a bag.

2. Description of the Related Art

Bag-in-box (BIB) type dispensing systems are known in the art. In terms of wine, for example, traditional BIB systems include a corrugated box including a removable perforated door on the front side near the bottom of the box. A bag or bladder filled with liquid and having a pre-attached spigot is positioned inside the box such that the spigot of the bag is near the perforated door. When the perforated door is removed, the spigot is accessible and positioned within the door for use. Traditional BIB systems are desirable for a variety of reasons including, inter alia, preventing or delaying oxidation of wine, lowering cost of manufacture, eliminating the risk of cork taint, and reducing environmental impact. For a variety of reasons, however, there are several problems with traditional BIB systems. For example, spigots are located at the bottom of the dispensing system, thereby requiring a user to lift the dispensing system or move the dispensing system to a countertop edge to create room for filling a glass. Additionally, in some situations gravity is insufficient to completely empty out the contents of the bag. Further, the aesthetic of the corrugated box may be unattractive to some consumers. Other types of traditional BIB systems likely suffer from similar problems.

SUMMARY OF THE INVENTION

Preferred embodiments of the present invention address at least one of the above, or additional, problems of traditional BIB systems. The preferred embodiments of the present invention are directed to a variety of liquid, e.g. wine, dispensing systems.

In a preferred embodiment of the present invention, a liquid dispensing system includes: a cavity arranged to receive the bag of liquid, the cavity includes a front wall; a spigot-recess defined on the front wall of the cavity and arranged to engage the spigot, the spigot-recess being located in the front wall; a top plate assembly arranged to be alternatingly positioned between an open position and a closed position, the top plate assembly including a pressure plate positioned at a top of the cavity, the pressure plate arranged to apply a downward force on the bag of liquid; a lifting plate arranged to lift the bag of liquid and to apply an upward force on the bag of liquid, the lifting plate arranged to move in the cavity between a bottom-most position and a top-most position which is different from the bottom-most position; a lifter assembly interfaced with the lifting plate, the lifter assembly arranged to guide the lifting plate to the top-most position and including at least one guide interfaced with a notch defined in an outer periphery of the lifting plate to orient a vertical ascent and descent of the lifting plate; and at least one biasing device arranged to apply a biasing force to one end to the lifting plate, the at least one biasing device including a collapsible support member.

In a preferred embodiment of the present invention, the at least one guide includes at least one elongated guide member extending towards a bottom surface of the cavity and the at least one elongated guide member includes a front pair of elongated guide members and a rear pair of elongated guide members; and the lifting plate includes a front pair of notches arranged to receive the front pair of elongated guide members and a rear pair of notches arranged to receive the rear pair of elongated guide members.

In a preferred embodiment of the present invention, the at least one biasing device further includes a piston and the collapsible support member is defined by a scissor lift and an upper surface of the lifting plate has a scalloped shape and/or a lower surface of the pressure plate includes a convex projection.

In a preferred embodiment of the present invention, the liquid dispensing system further includes an engaging member arranged on the lifting plate; and a retaining member arranged on a base of the cavity; wherein the retaining member is arranged to fix the lifting plate in the bottom-most position by engaging with the engaging member. The retaining member is arranged to release the engaging member of the lifting plate when the top plate assembly is moved into the closed position.

In a preferred embodiment of the present invention, the spigot-recess is cantilevered relative to the front wall at a distance so as to define a clearance beneath the spigot-recess, the clearance is arranged to allow a drinking glass to be positioned, at least in part, under the spigot engaged with the spigot-recess.

In a preferred embodiment of the present invention, the liquid dispensing system further includes a heating and/or cooling system and an internal battery.

In a preferred embodiment of the present invention, the top plate assembly further includes a spigot-recess cap cantilevered relative to the front wall and configured to abut a top of the spigot-recess and the top plate assembly includes a hinge near the back wall of the cavity arranged to allow pivotal movement between the open position and the closed position.

In a preferred embodiment of the present invention, the pressure plate of the top plate assembly is vertically aligned with the lifting plate. The lifting plate includes a first slope including a top end and a bottom end that is lower than the top end, the top end of the first slope being positioned proximal to the back wall and the bottom end of the first slope being positioned proximal to the front wall. When the lifting plate is in the top-most position, the bottom end of the first slope is positioned proximal to the spigot recess. The pressure plate includes a second slope including a top end and a bottom end that is lower than the bottom end of the second slope, the top end of the second slope being positioned proximal to the back wall and the bottom end of the second slope being positioned proximal to the spigot-recess when the pressure plate assembly is in the closed position.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described in detail with reference to the accompanying drawings. Note that the present invention is not limited to the preferred embodiments described below. It is to be understood by those skilled in the art that variations and modifications can be made appropriately as long as desired effects of the present invention are not, or are substantially not, impaired. Also note that various features, elements and characteristics of the preferred embodiments described below may be combined with each other if so desired.

Figure 1:
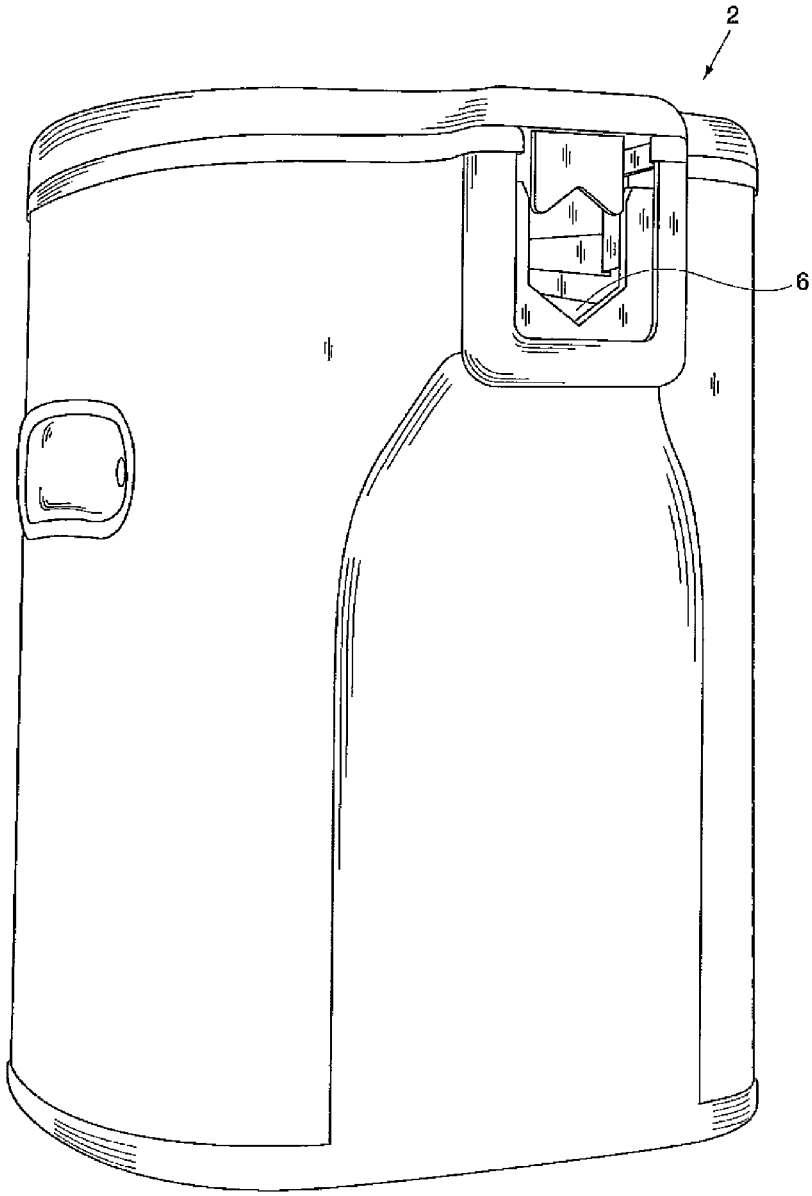
FIG. 1 shows a perspective view of one liquid dispensing system in accordance with a preferred embodiment of the present invention.
Figure 2:
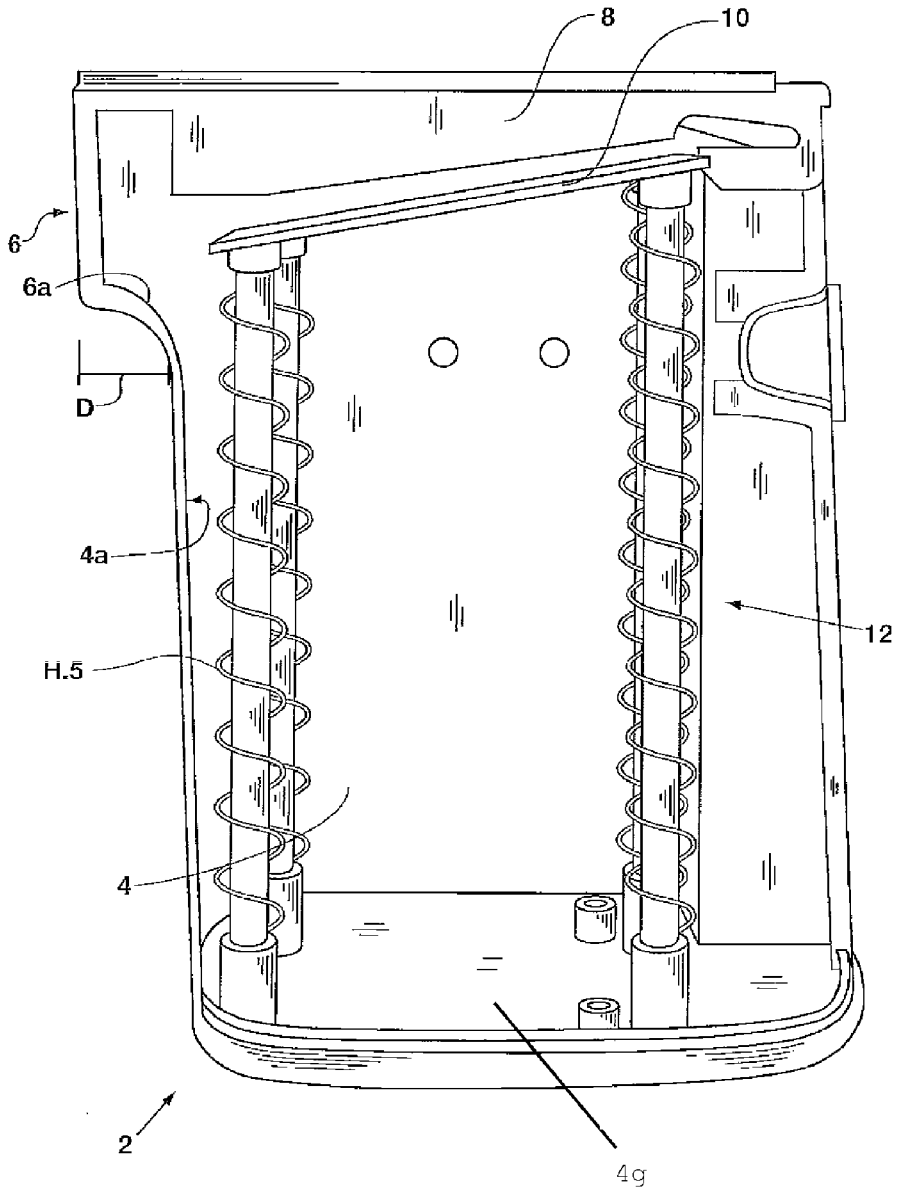
FIG. 2 shows a cutaway side view of a liquid dispensing system in accordance with a preferred embodiment of the present invention.

The current disclosure is inclusive of a variety of liquid dispensing systems arranged to dispense liquid from a bag including a pre-attached spigot. FIGS. 1-13 illustrate various views of one preferred embodiment of the present invention, and are also useful for describing a variety of additional preferred embodiments of the present invention. FIG. 1 shows a perspective view of one preferred embodiment of a liquid dispensing system 2 as described herein. FIG. 2 shows a cutaway side view of the liquid dispensing system 2, which allows for the visualization of various components. Referring generally to FIG. 2, system 2 preferably includes a cavity 4, which is preferably defined by a casing of the system, arranged to receive, for example, a bag of liquid including a spigot (not shown in this figure); a spigot recess 6 shaped to engage the spigot; a top plate assembly 8; a lifting plate 10; and a lifter assembly 12. Components of the liquid dispensing system 2 will be explained in more detail below.

Figure 3:
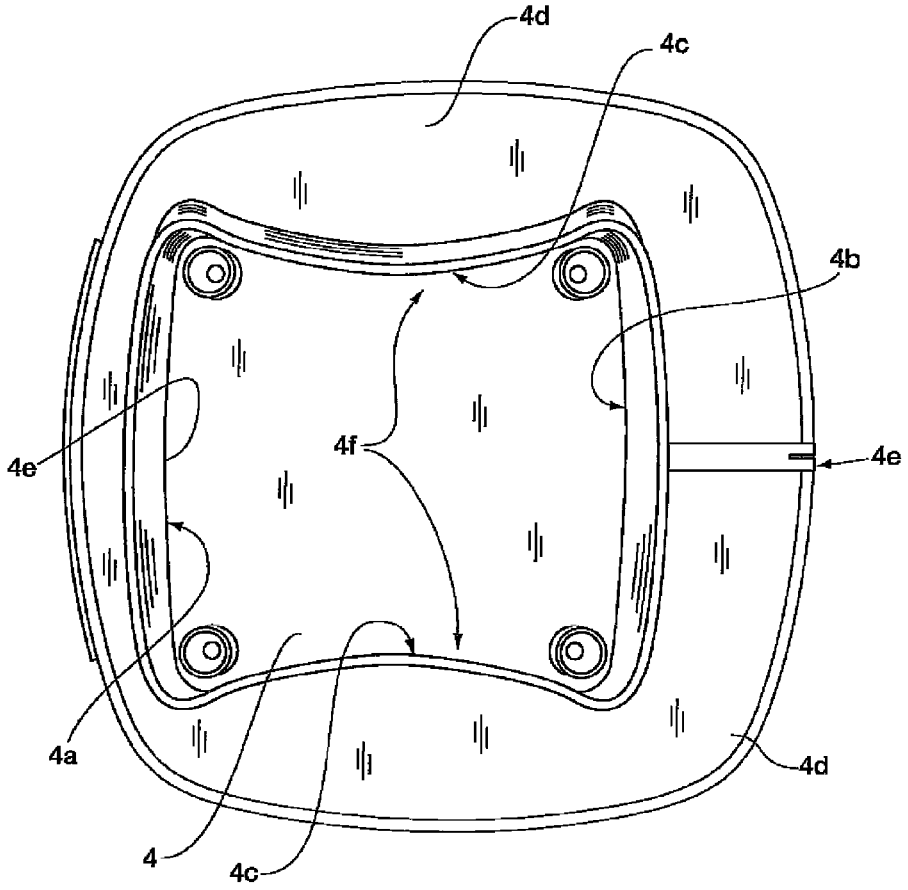
FIG. 3 shows a partial internal cutaway view of the bottom of a liquid dispensing system in accordance with a preferred embodiment of the present invention.

FIG. 3 shows a cutaway top view of the cavity 4. A variety of cavity shapes and sizes may be used for receiving the bag of liquid, in this example, cavity 4 is defined by a casing which includes a front wall 4*a*, a back wall 4*b*, and a pair of lateral walls 4*c*. Each of the front wall 4*a*, the back wall 4*b*, and the pair of lateral walls 4*c* may be solid or non-solid and may be made from any number of components. In the example shown, walls 4*a*, 4*b*, and 4*c* are preferably held together through the use of a plurality of cavity caps 4*d* that mate along line 4*e*. The cavity caps 4*d* are preferably arranged to be fixed on upper surfaces of the walls 4*a*, 4*b*, and 4*c* through fasteners, such as, for example, screws, bolts, clamps, rivets, welds, adhesive, etc. The cavity 4 also preferably includes a base portion 4*g* upon which lower portions of the walls 4*a*, 4*b*, and 4*c* are mounted.

A total volume of the cavity 4 may vary from example to example to, for example, accommodate various volumes of liquid contained in a bag. In many examples (e.g., in those examples of cavities 4 intended to contain wine) cavities 4 are preferably configured to receive a bag containing approximately 3 liters of liquid. Other examples may be configured to include cavities 4 which are arranged to contain more or less liquid. Some system examples may also include more than one cavity 4, e.g., two, three, four, etc.

In many examples, at least one of the walls of the cavity 4, e.g. one of the front 4*a*, back 4*b*, or lateral 4*c* walls, will include an inwardly facing guide surface. For example, lateral surface 4*c* may be considered to include an inward bend 4*f* defining an inwardly facing guide surface, for inter alia, directing liquid contents in a bag inwardly. In the preferred embodiment shown in FIG. 3, both of the lateral walls 4*c* include an inward bend 4*f*. The inwardly facing guide surface defined by the inward bend 4*f* may extend from about the bottom-most position of the lifting plate 10 within the cavity 4 to about the top-most position of the lifting plate 10 within the cavity 4.

Figure 4:
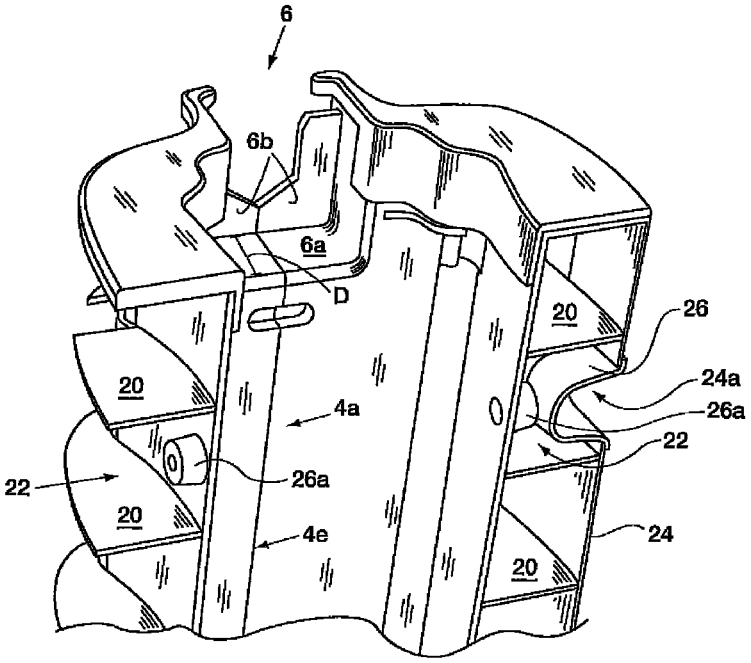
FIG. 4 shows a partial internal cutaway view of the front of a liquid dispensing system in accordance with a preferred embodiment of the present invention.

Referring back to FIG. 2, the front wall of the cavity, e.g., front wall 4*a*, will have an upper half, e.g. the portion of above H.5, and spigot recess 6 will be defined in the upper half. In some examples, the spigot recess will be in the upper third, the upper fourth, or at the very top of the front wall. FIG. 4 illustrates an internal view of front wall 4*a* including spigot recess 6.

The spigot recesses 6 is preferably cantilevered relative to the front wall 4*a* at a distance sufficient to allow a drinking glass to be positioned, at least in part, under a spigot positioned within the spigot-recess 6. One cantilevering example is illustrated, inter alia, in FIG. 2 and FIG. 4. In this preferred embodiment, front wall portion 6*a* extends distally for a distance D. Distance D may vary from example to example. For example, if a spigot has a length L from its bag interface to the distal edge, then D may preferably be in the range of about 0.5 L to about 4 L. In this preferred embodiment, the cantilevered portion preferably is horizontal or substantially horizontal, but it other examples, cantilevered portions may be non-horizontal, include non-horizontal portions, etc. Further, while in this example, portion 6*a* is defined in the front wall 4*a*, in other examples, other structures may be used to cantilever, e.g. beams, flanges, etc. Some system examples, e.g. those including a plurality of cavities, may also include a plurality of any of the variety of spigot recesses.

Spigot recesses may also include a downward tapering portion defined at the bottom of the spigot recess. FIG. 4 illustrates one example of a downward tapering portion 6*b* defined in a spigot recess. Downward tapering portions are useful for improving the secure interface of the spigot in the spigot recess. A preferred size of the downward tapering portion 6*b* may vary based on spigot size. For example, the upper end of the downward tapering portion 6*b* may be larger than the diameter of the portion of the spigot neck configured to be received in the spigot recess 6, and the bottom end of the downward tapering portion 6*b* may be approximately the same size, or smaller, than the portion of the spigot neck configured to be received by the spigot recess 6.

Figure 5:
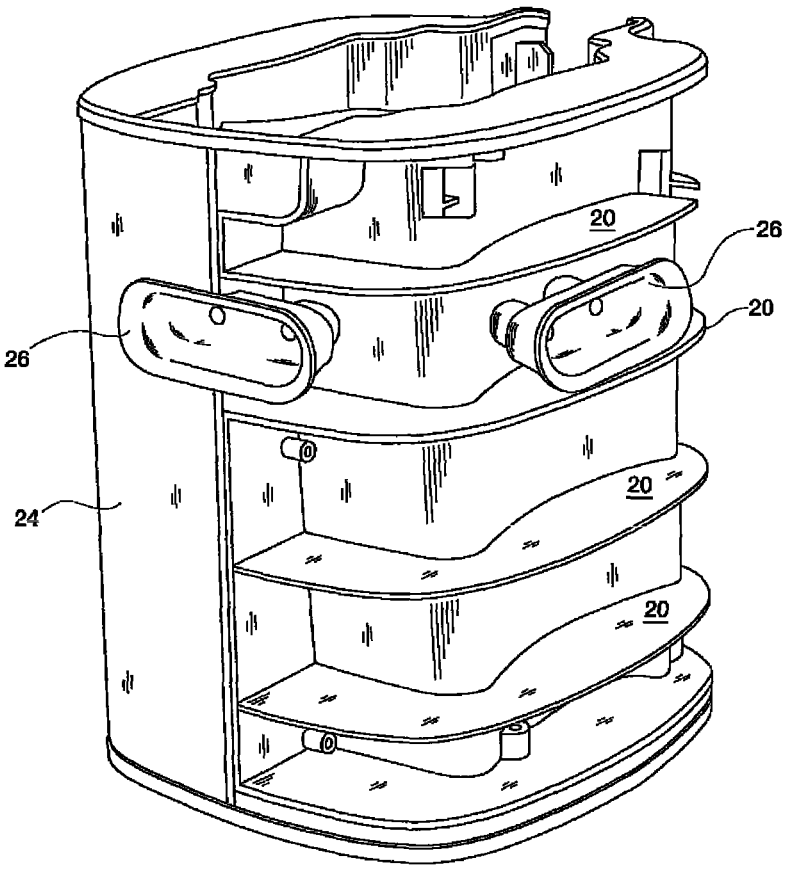
FIG. 5 shows a partial external perspective view of a liquid dispensing system in accordance with a preferred embodiment of the present invention.

Cavities 4 may also include a plurality of external ribs 20 arranged to, inter alia, create a desired final shape of the system 2, define at least one handle hole to facilitate moving the system 5, etc. In FIG. 4, a plurality of external ribs 20 are visible. In this example, the ribs 20 are preferably oriented with horizontal or substantially horizontal planes and are spaced vertically. However, other examples, include other orientations, e.g., vertical planes with horizontal spacing, etc. As seen, ribs 20 define at least one handle chamber 22. Systems 2 may additionally include an external shell 24 located, at least in part, distally to the external ribs 20. In FIG. 4, the external shell 24 on the left hand side of the system has been removed to facilitate viewing. In many examples, the external shell 24 will additionally include at least one handle hole, e.g., handle hole 24*a*, configured to align with at least one handle chamber, e.g. chamber 22. The resulting void may define a handle for moving or manipulating the system. Some examples may further include, for aesthetic reasons for example, a handle structure, e.g., structure 26, is preferably positioned within the handle hole 24*a* and the handle chamber 22. If a handle is desired, the handle may be interfaced with a variety of fasteners represented by fastener portion 26*a*. FIG. 5 illustrates another view of the ribs 20, the shell 24, and the handle 26. Cavities may additionally include spaces arranged to house heating or cooling elements, e.g., ice packs for white wine, heating packs for cider, etc. Heating and cooling elements may also include compressors used in cooling and electric heating strips used in heating. These types of elements may be positioned in a variety of locations, e.g. within voids defined by ribs or adjacent to internal walls, etc.

Figure 6A:
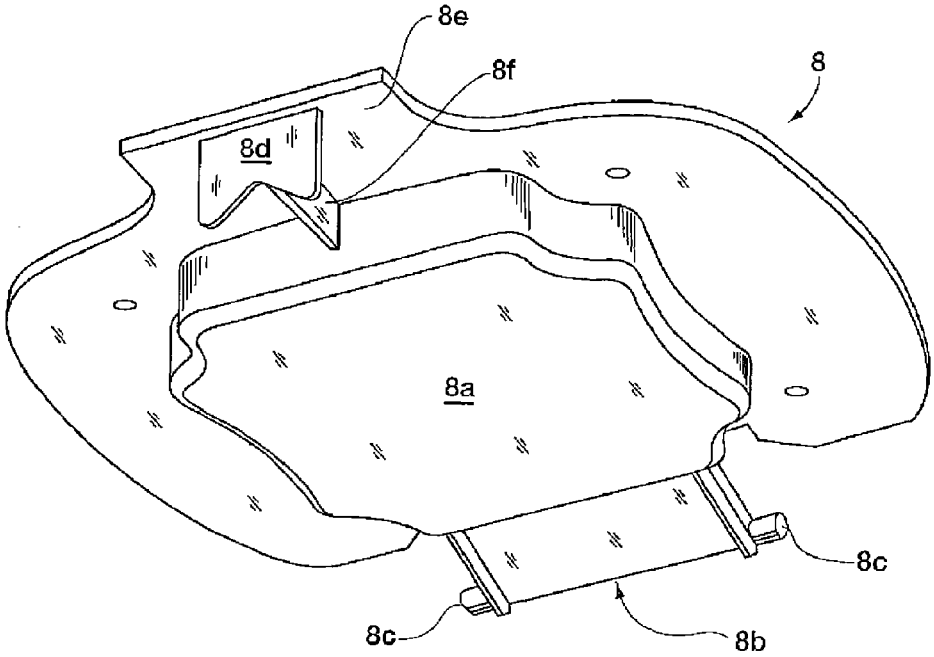
FIGS. 6*a* and 6*b* show isolated views of a top plate assembly in accordance with a preferred embodiment of the present invention.
Figure 6B:
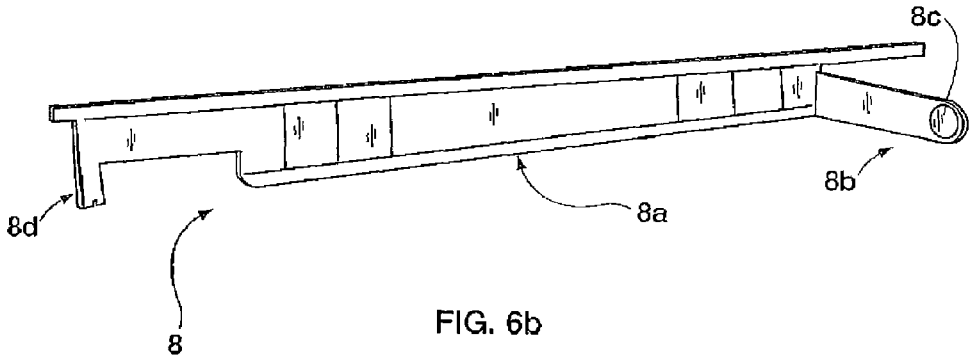

FIGS. 6*a* and 6*b* show various isolated views of top plate assembly 8 according to a preferred embodiment of the present invention. Top plate assembly 8 preferably includes a pressure plate 8*a* arranged to be positioned in the top of the cavity 2 and to apply a downward force on the bag of liquid. Top plate assembly 8 is arranged to be alternatingly positioned between an open position (e.g., allowing a bag of liquid to be placed within the cavity 2) and a closed position (e.g. fixedly positioning the pressure plate to apply the downward force). The open and closed positions may be achieved in a variety of ways. For example, in one preferred embodiment of the present invention, the top plate assembly 8 may be completely detachable from the other components of the system 2, wherein the open position corresponds to a detachment of the top plate assembly 8, and a closed position corresponds to an attachment of the top plate assembly 8. In other preferred embodiments of the present invention, the top plate assembly 8 may be slideably receivable by grooves on an upper portion of the system 2, wherein the open positioned corresponds to a distal sliding of the top plate assembly 8 such that a bag of liquid may be positioned in the cavity 4, and a closed position corresponds to a sliding of the top plate assembly 8 such that the pressure plate 8*a* is at least partially aligned with the cavity 4. In some preferred embodiments of the present invention, the top plate assembly 8 may be pivotally mounted to the system. Referring to FIGS. 6*a* and 6*b* for example, top plate assembly 8 according to a preferred embodiment of the present invention may preferably include a hinge arm 8*b* ending from the pressure plate 8*a* and including pivot points 8*c* permitting pivotal mounting of the top plate assembly 8. In this preferred embodiment, when the top plate assembly 8 is pivoted upwardly to allow access to the cavity 4 it is in its open position, and when top plate assembly 8 is pivoted downwardly to position pressure plate 8*a* in its position to apply a downward force, it is in its closed position. Any other desirable type of hinge may alternatively be used.

Top plate assemblies 8 may also include a spigot-recess cap (e.g., spigot-recess cap 8*d*) arranged to abut a top of the spigot recess 6, for example, to improve the purchase on a spigot contained within the spigot recess 6, in many examples, the spigot-recess cap will be cantilevered relative to the front wall a distance sufficient to be proximal to the spigot recess, e.g. similar to distance D of the spigot recess cantilever, in the example shown, cap 8*d* is cantilevered by portions 8*e* and 8*f* of the top plate assembly. In other examples, caps may be cantilevered in other ways, e.g., a pair of parallel beams, etc. Further, in examples including multiple cavities, a combination of multiple top plate assemblies may be used.

Figure 7:
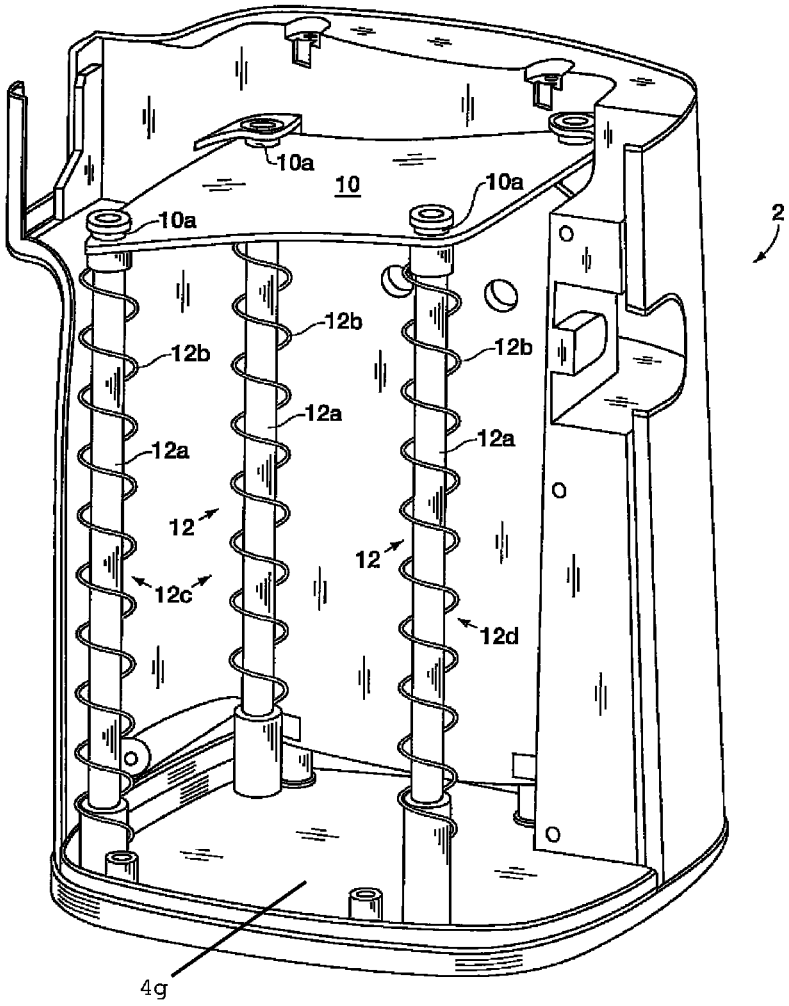
FIG. 7 shows a perspective view of a liquid dispensing system in accordance with a preferred embodiment of the present invention with various components removed to facilitate viewing.

FIG. 7 illustrates a perspective view of the system 2 with various components removed to facilitate viewing of lifting plate 10, which is interfaced with lifter assembly 12. Typically, the lifter assembly 12 in accordance with a preferred embodiment of the present invention will include at least one guide interfaced with the lifting plate 10 and at least one biasing device, e.g. a spring, attached to provide a biasing force to the lifting plate 10. The at least one guide orients vertical ascent and descent of the lifting plate 10, and the at least one biasing device biases the lifting plate 10 in the direction of the pressure plate 8*a*.

Guides may vary. For example, the guides may include at least one channel defined in the side of the chamber so as to receive a portion of the lifting plate or the guides may include at least one post or elongated support interfaced with a void in the lifting plate 10. In the preferred embodiment of the present invention shown in FIG. 7, guides preferably include a plurality of guide posts 12*a*, interfaced with lifting plate 10 through a plurality of voids 10*a* defined in the lifting plate. The lifter assembly's biasing device includes a plurality of springs 12*b* surrounding the guide posts. In other examples, voids may be in other locations, e.g., closer to the perimeter of the lifting plate 10 such that they are only partially defined by the lifting plate 10. Springs or other biasing devices may similarly be attached in a variety of fashions at a variety of locations. In some examples, guides may include telescoping structures that collapse on themselves when a bag of liquid is contained within the cavity, and which may extend with spring biasing, e.g. as liquid is removed from the bag. Further, in examples including multiple cavities, any combination of multiple lifter assemblies 12 may be used.

In the present preferred embodiment of the present invention, the guide posts 12*a* preferably include a front pair of guide posts 12*c* and a rear pair of guide posts 12*d*, with the lifting plate 10 including a front pair of apertures 10*a* to receive the front pair of guide posts 12*c* and a rear pair of apertures 10*a* to receive the rear pair of guideposts 12*d*. The springs 12*b* preferably include, for example, compression springs arranged to store energy when compressed. Spring force may vary depending on, for example, the number of springs 12*b* used, the size of the volume or weight of the liquid being received by the chamber 4, etc.

Typically, for most consumer beverages, springs 12*b* will be configured such that a lifting plate 10 can be depressed by a weight in the range of at least one of about 6 lbs. to about 13 lbs., and about 0.5 lbs. to about 3 lbs., for example. In some examples, e.g., systems for dispensing liquid from 9 liter bags, springs may be configured to provide a lifting force in the range of about 20-40 lbs., for example. Different numbers of biasing devices (e.g., a different number of springs) may be used to achieve the desired biasing force. Springs may preferably be configured to have a lifting force sufficient to move the lifting plate 10 upward as liquid is removed from the bag. In some examples, springs will be configured to have a greater lifting force than the downward force created by the full bag of liquid. In such examples, a user may apply additional downward force to depress the lifting plate 10 an amount sufficient to move the top plate assembly 8 to the closed position.

Figure 8:
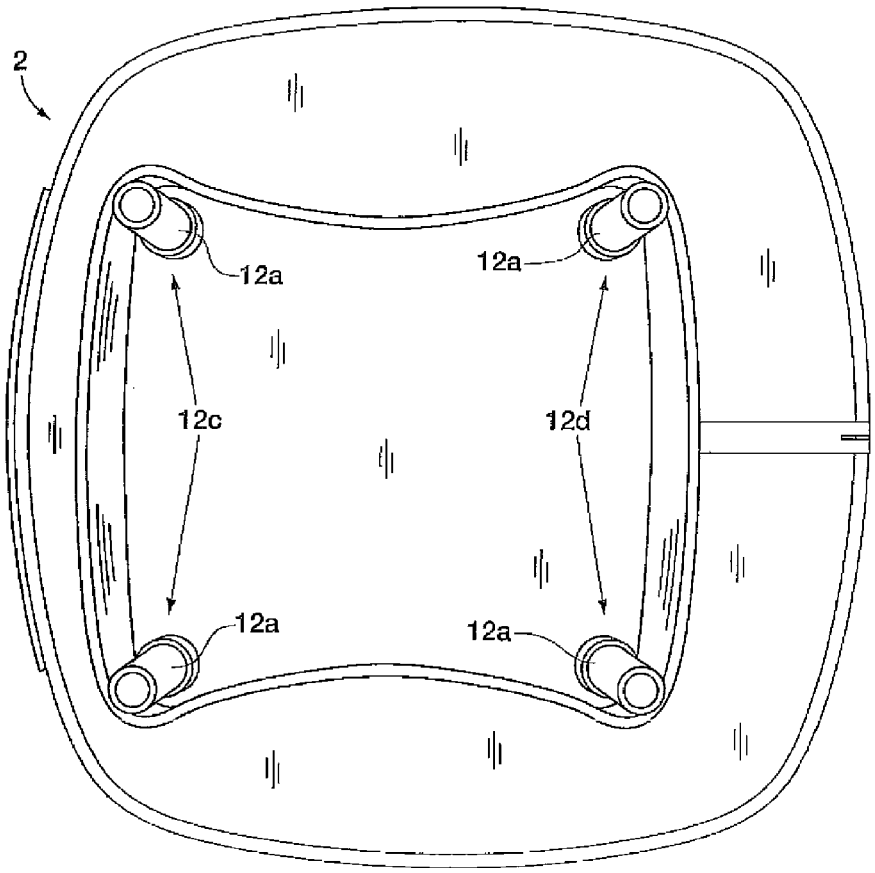
FIG. 8 shows a partial internal cutaway view of the bottom of a liquid dispensing system in accordance with a preferred embodiment of the present invention, illustrating a guide post thereof.
Figure 9:
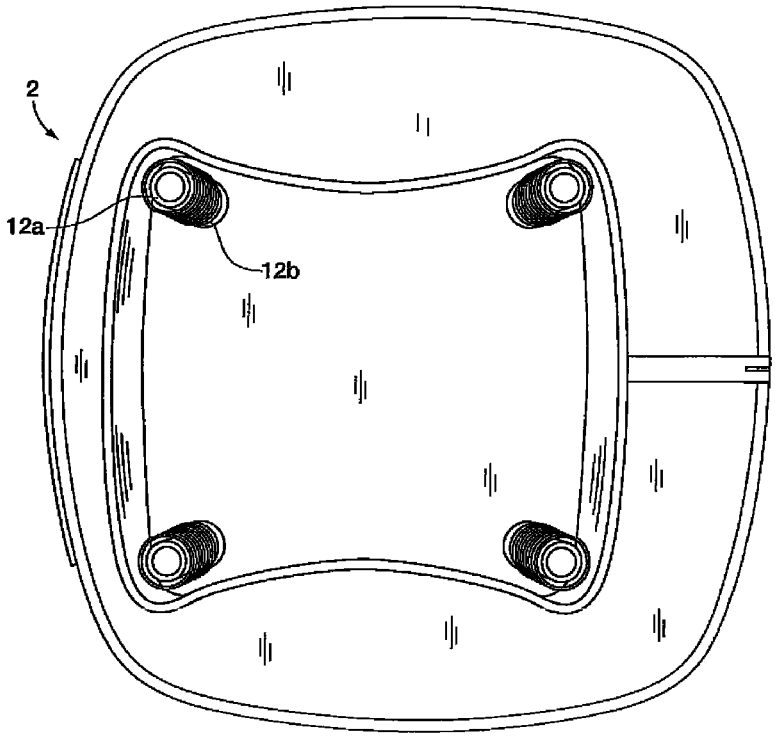
FIG. 9 shows a partial internal cutaway view of the bottom of a liquid dispensing system in accordance with a preferred embodiment of the present invention, illustrating a guide post and spring configuration thereof.

FIG. 8 illustrates a partial cutaway view of system 2 further illustrating guides 12*a*. FIG. 9 illustrates the view of FIG. 8, further including springs 12*b* positioned around guides 12*a*.

Figure 10:
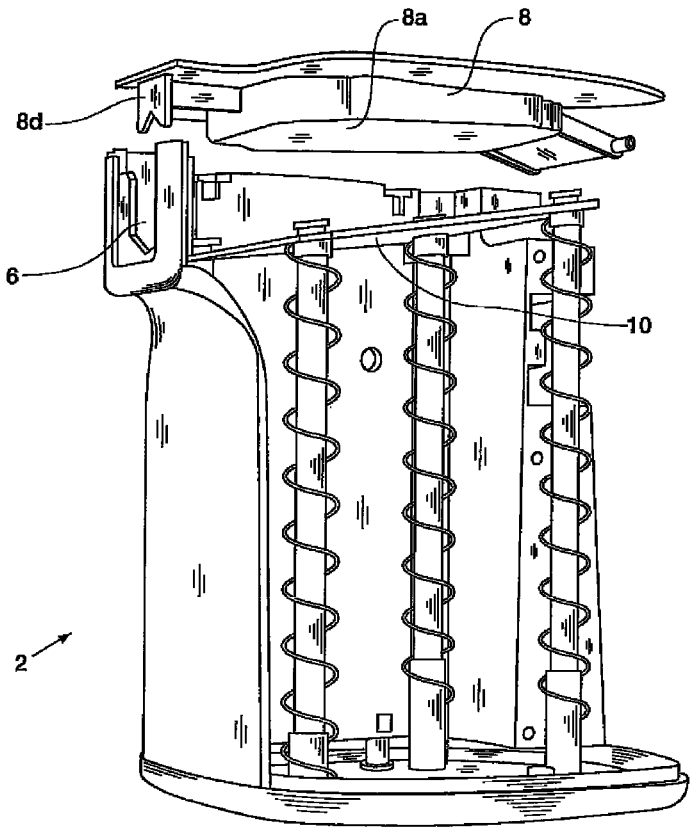
FIG. 10 shows a perspective view of a liquid dispensing system in accordance with a preferred embodiment of the present invention with various components removed to facilitate viewing.

FIG. 10 illustrates another view of system 2 with the top plate assembly 8 raised and a wall portion removed to facilitate viewing. Pressure plate 8*a* is shown with at least a portion vertically aligned with lifting plate 10. Further, the spigot-recess cap 8*d* is illustrated as cantilevered and just above the spigot recess 6. By lowering top plate assembly 8 slightly, such as when in use, spigot-recess cap 8*d* will abut spigot recess 6.

Figure 11:
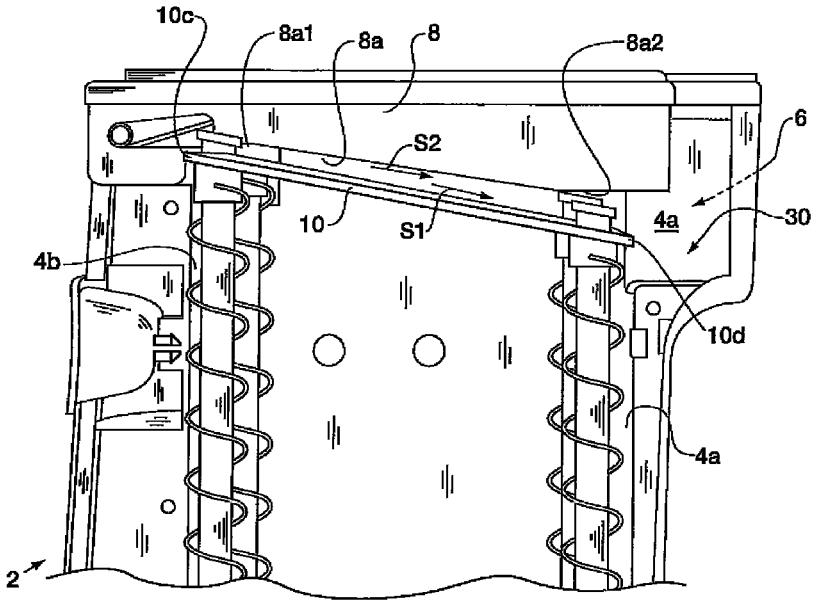
FIG. 11 shows a cutaway close up view of a liquid dispensing system in accordance with a preferred embodiment of the present invention.

In many preferred embodiments of the present invention, at least one of the lifting plate 10 and the pressure plate 8*a* will include a downward slope in the direction of the spigot recess 6 and at least an upper surface of the lifting plate 10 or a lower surface of the pressure plate 8*a* will have a horizontally scalloped or convexly curved surface arranged to direct liquid in horizontally outward portions of the bag including a spigot, towards the spigot recess 6. FIG. 11 illustrates a close-up partial side view of system 2 useful for illustrating, inter alia, the slope of the lifting plate. Lifting plate 10 may be considered to have a bottom end 10*d* (e.g. proximal to the front wall 4*a*) and a top end 10*c* (e.g. proximal to the back wall 4*b*) where the bottom end 10*d* is lower than the top end, thereby creating a first slope with a direction of slope indicated by arrow S1. When the lifting plate is in its top-most position within the cavity 4, e.g. as shown in FIG. 11, the position, the bottom end 10*d* of the first slope is positioned proximal to spigot-recess 6.

As noted, the pressure plate 8*a* may similarly include a downward slope. In this preferred embodiment of the present invention, the pressure plate 8*a* preferably includes a top end 8*a*1 and a bottom end 8*a*2 that is lower than the top end 8*a*1. The top end 8*a*1 is positioned proximal to the back wall 4*b* and the bottom end 8*a*2 is positioned proximal to the front wall 4*a*. The bottom end 8*a*2 may be positioned proximal to the spigot-recess 6 when the pressure plate assembly 8 is in its closed position. The pressure plate 8*a* accordingly includes a second slope with the direction of slope indicated by arrow S2. In this preferred embodiment, the first and second slopes S1 and S2 are preferably directed to extend in a same or similar manner. However, in other preferred embodiments, the first and second slopes S1 and S2 may have different values.

FIG. 11 also illustrates a pooling chamber 30 which is preferably positioned between the bottom end of the first slope 10*d* and the spigot-recess 6. The pooling chamber 30 may preferably further be defined, at least in part, by portions of the front wall 4*a* and the cantilevered portion of the spigot recess 6. The pooling chamber 30 preferably allows, inter alia, a portion the bag containing liquid to be positioned therein, whereby liquid may collect, in some examples, pooling chambers 20 will further allow liquid contents in a bag to pool to permit improved extraction from the bag of liquid. Liquid pooling chambers may similarly serve as a decompression chamber, for example, to maintain a more consistent flow rate when liquid is being dispensed.

Figure 12:
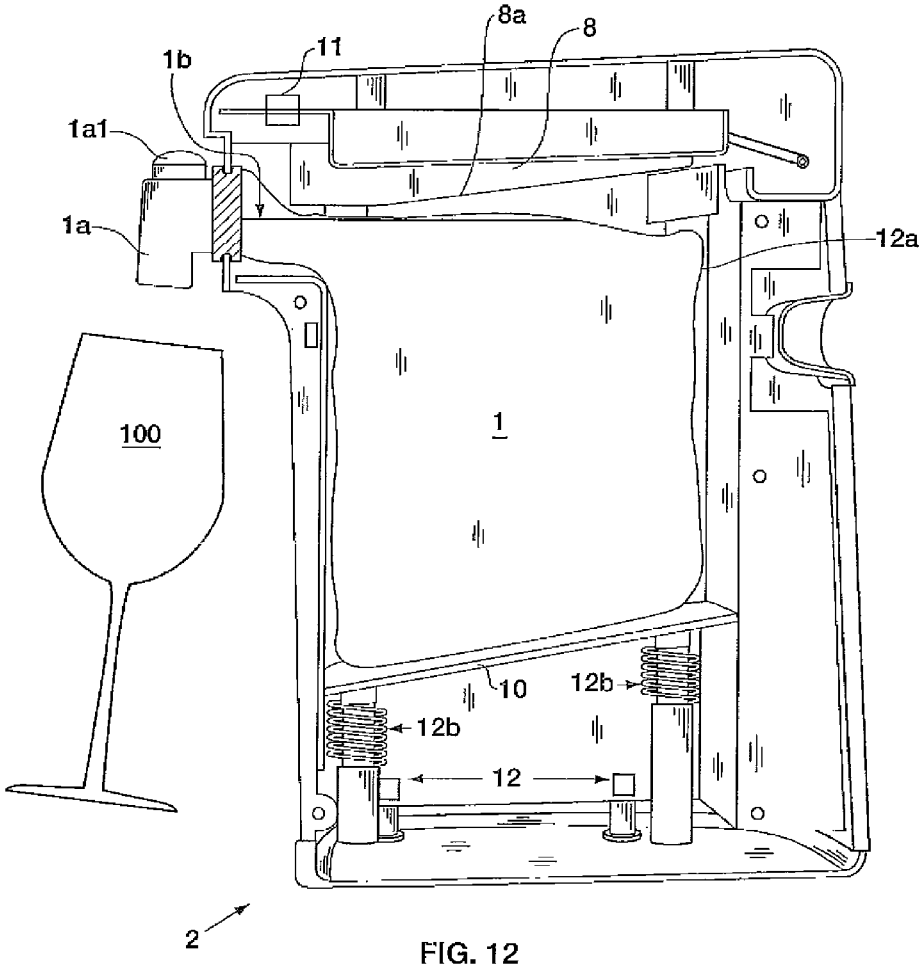
FIGS. 12 and 13 show a liquid dispensing system in accordance with a preferred embodiment of the present invention in use.

FIG. 12 illustrates one preferred embodiment of a system 1 containing a bag of liquid 1 including a pre-attached spigot 1*a*. The bag 1 is preferably positioned on top of lifting plate 10, and the downward gravitational force of bag 1 depresses the lifting plate 10. Because of the downward gravitational force, the springs 12*b* of the lifting mechanism 12 are compressed. The top plate assembly 8 is in its closed position, thereby allowing pressure plate 8*a* to apply a downward force in areas where it comes into contact with bag 1. The top plate assembly 8 is preferably latched in its closed position by latch 11. A variety of latches, e.g., spring, slam, cam, Norfolk, Suffolk, crossbar, cabin hook, bolt, compression, rotary, etc. may be used to secure the top plate assembly 8. Additionally, any number of latches may be located in a variety of locations, e.g. the side front or back of the system. A drinking glass 100 is positioned under spigot 1*a*. A user desiring liquid from bag 1 may open spigot 1*a* (e.g., by operating valve through button 1*a*1) thereby allowing liquid to flow into the glass 100. Spigot valves may vary, including for example, various levers, screw valves, push button valves, etc. As liquid released from bag 1, the lifting assembly 12 continues to lift the bag 1 of liquid, thereby maintaining a liquid level 1*b* which is in contact with spigot 1*a*.

Figure 13:
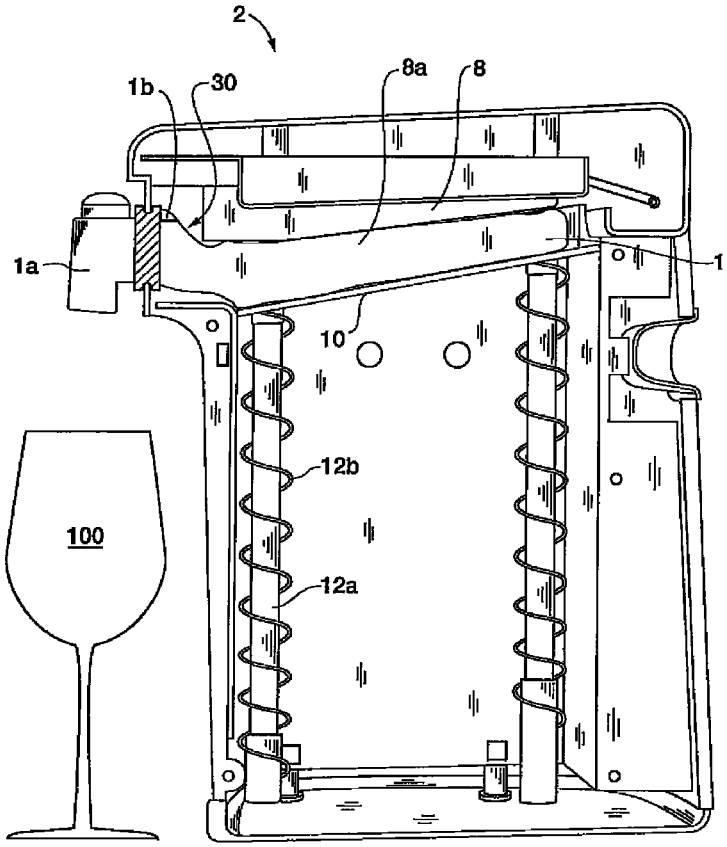

FIG. 13 illustrates the system 2 after most of the liquid has been removed from bag 1. The bag 1 is compressed between the lifting plate 10 and the pressure plate 8*a* to thereby force the last remaining liquid into the pooling chamber 30, as illustrated by liquid level 1*b*. As illustrated, liquid in the bag 1 can preferably be readily accessed without requiring any manipulation, e.g. lifting, tilting, sliding to the edge, etc. of the system. Further, in many preferred embodiments of the present invention, systems will allow the users to empty a liquid volume range of 90% to 100% of total liquid volume, 95% to 100% of total liquid volume, and 97% to 100% of total liquid volume without requiring any manipulation of the system.

FIGS. 12 and 13 are also useful for illustrating the top-most and bottommost positions of the lifting plate 10 within the cavity 4. In many examples, the top-most and bottommost positions of the lifting plate 10 will be controlled by the lifter assembly 12. For example, in FIG. 12, the bottom-most position of the lifting plate 10 is determined by the height of springs 12*b* when fully compressed, and the top-most position will be determined by the lifting plate's 10 interface with the guide.

Figure 14:
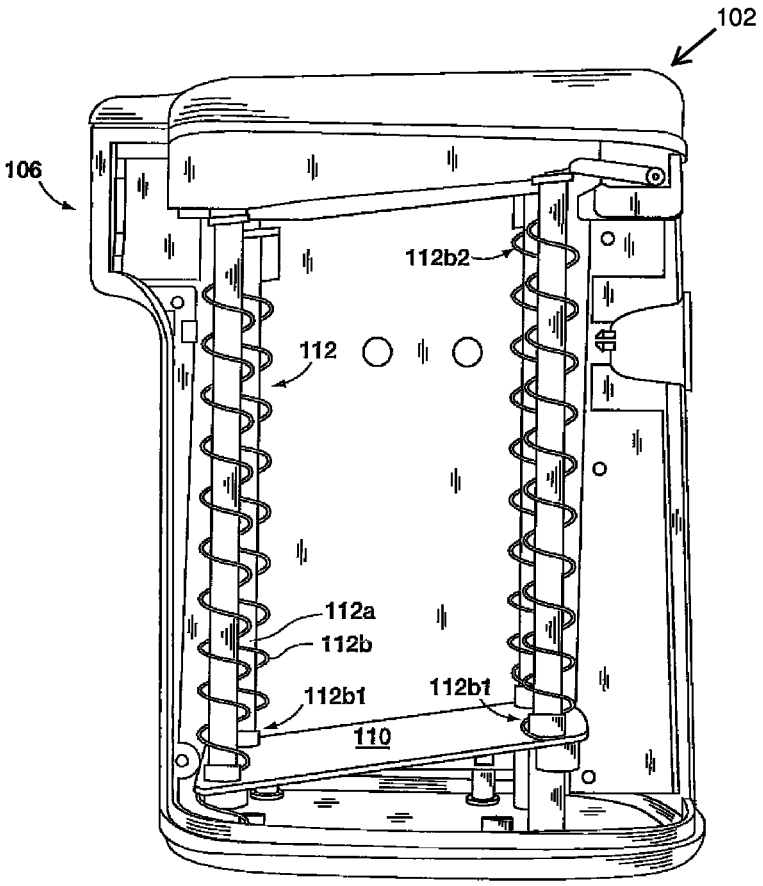
FIG. 14 shows an example of another liquid dispensing system in accordance with a preferred embodiment of the present invention.

FIG. 14 illustrates another system according to a preferred embodiment of the present invention, referred to as system 102. System 102 is generally similar to system 2, however, the lifter assembly 112 has a slightly different configuration. The lifter assembly 112 preferably includes tension springs 112*b* which store their energy when extended as shown. In this example, tension springs 112*b* attached to the lifting plate near their bottom ends, e.g. 112*b*1, and are fixedly attached near their upper ends, e.g. 112*b*2, to some higher point in the system. In this example, springs ends 112*b*2 are fixedly attached to a higher portion of guide posts 112*a*, but in other examples, they may be attached in other places, e.g. to a wall or top plate assembly.

In the illustration shown, lifting plate 110 may be considered to be in its bottom-most position, e.g. springs 112*b* are fully extended. In its top-most position, springs 12*b* would be relaxed and the bottom end of lifting plate 110*b* would typically be proximal to spigot recess 106. Spring tensions, in this example may be similar to the spring forces of the preferred embodiments described above.

FIGS. 15-18 illustrate another system according to another preferred embodiment of the present invention, referred to as system 2'. System 2' is generally similar to system 2, however, the top plate assembly 8', the lifting plate 10', and the lifter assembly 12' have different configurations such that system 2' to provide increased durability. For the sake of brevity, elements in system 2' which are similar to the elements in system 2 will be referred to with the same reference characters and will not be explicitly described below.

Figure 15:
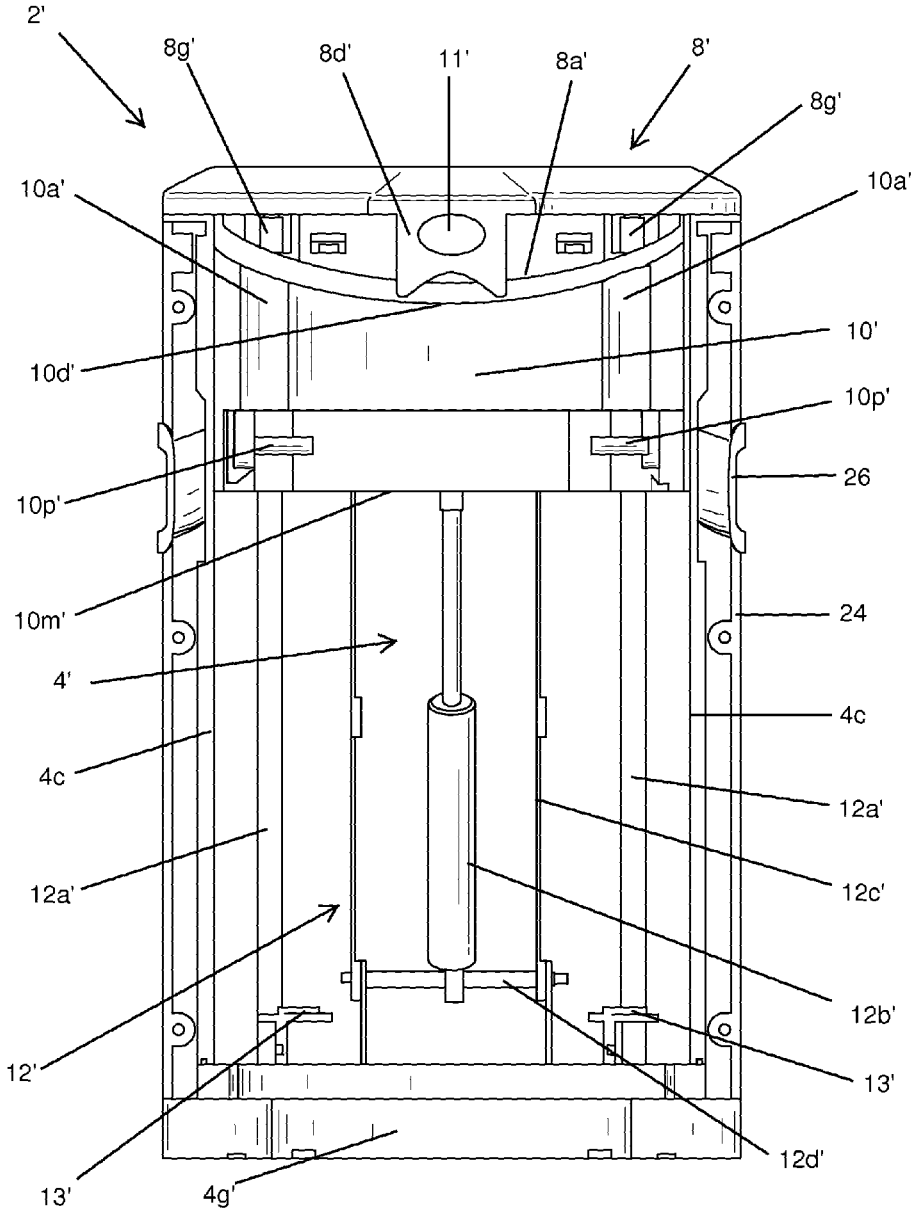
FIG. 15 shows a cutaway front view of an example of yet another liquid dispensing system in accordance with another preferred embodiment of the present invention.
Figure 16:
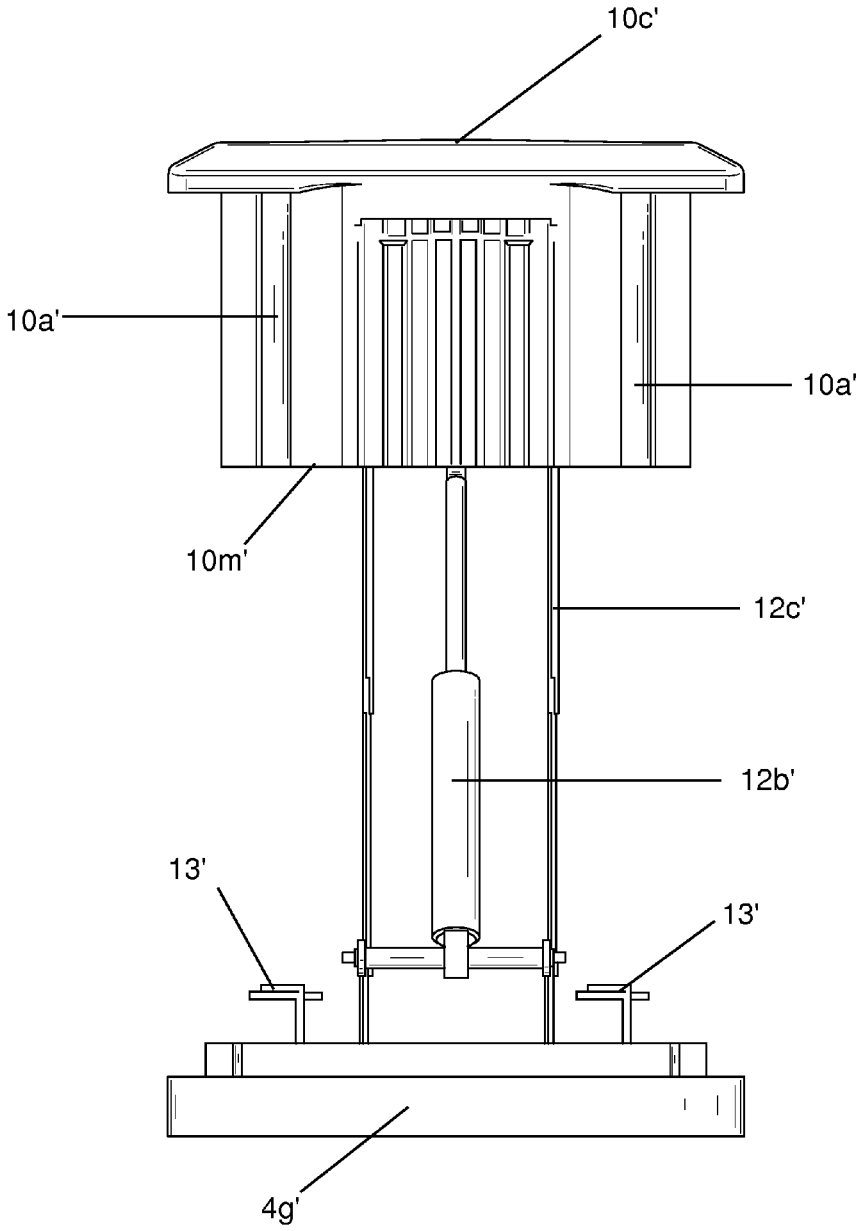
FIG. 16 shows a rear view of a lifter assembly and a lifting plate in accordance with another preferred embodiment of the present invention.
Figure 17:
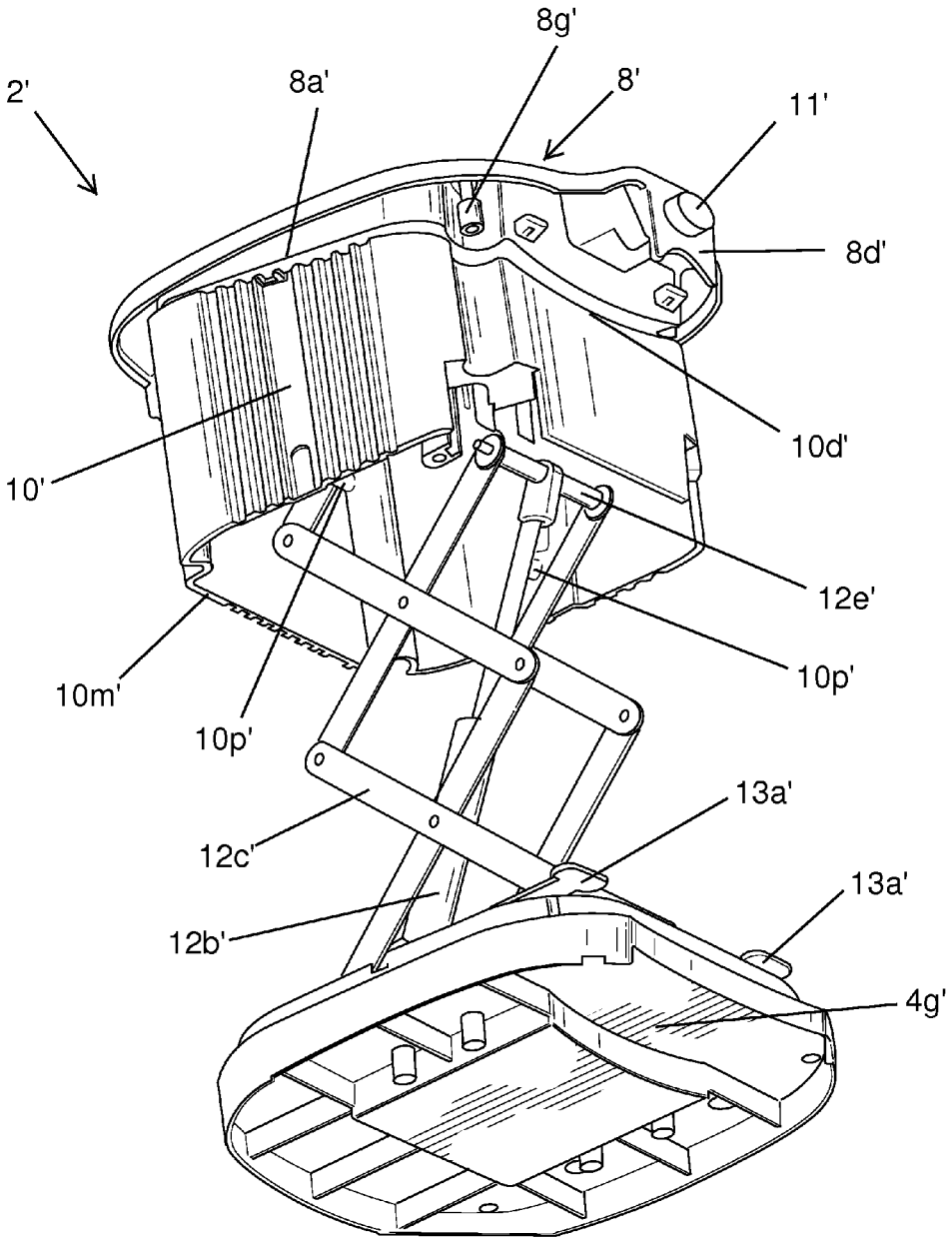
FIG. 17 shows a lower perspective view of a lifter assembly and a lifting plate opposed to a top plate assembly in accordance with another preferred embodiment of the present invention.

As shown in FIGS. 15-17, the lifting plate 10' of the present preferred embodiment preferably has a thick inverted cup shape. The upper surface of the lifting plate 10' preferably includes an upper surface including a top end 10*c'* and a bottom end 10*d'*. The upper surface of the lifting plate 10' defines a scalloped surface which slopes both inwardly and also from the top end 10*c'* to the bottom end 10*d'* of the lifting plate 10' to thereby direct a liquid in a bag inserted into and contained in the system 2' towards a spigot recess and pooling chamber of the system 2'. Additionally, the top plate assembly 8' also preferably includes a pressure plate 8*a'* which possesses a sloping convex shape which projects downward and inward in a manner which substantially corresponds with the scalloped upper surface of the lifting plate 10'.

As with the above-described preferred embodiments of the present invention, the lifting plate 10' of the present preferred embodiment is preferably arranged to be supported to move from a lower position within the cavity 4' to an upper position within the cavity 4' with the aid of the lifter assembly 12'. The lifter assembly 12' preferably includes at least one elongated guide member 12*a'* which is defined in one of the walls of the cavity 4' and which is correspondingly interfaced with at least one void 10*a'* defined in a side surface of the lifting plate 10'. The at least one void 10*a'* is preferably defined by, for example, a notch defined in the side of the side surface lifting plate 10'. The at least one elongated guide member 12*a'* is arranged to retain the lifting plate 10' in a properly aligned and relatively level position as the lifting plate 10' moves from the lower position within the cavity 4' to the upper position within the cavity 4'.

Figure 18:
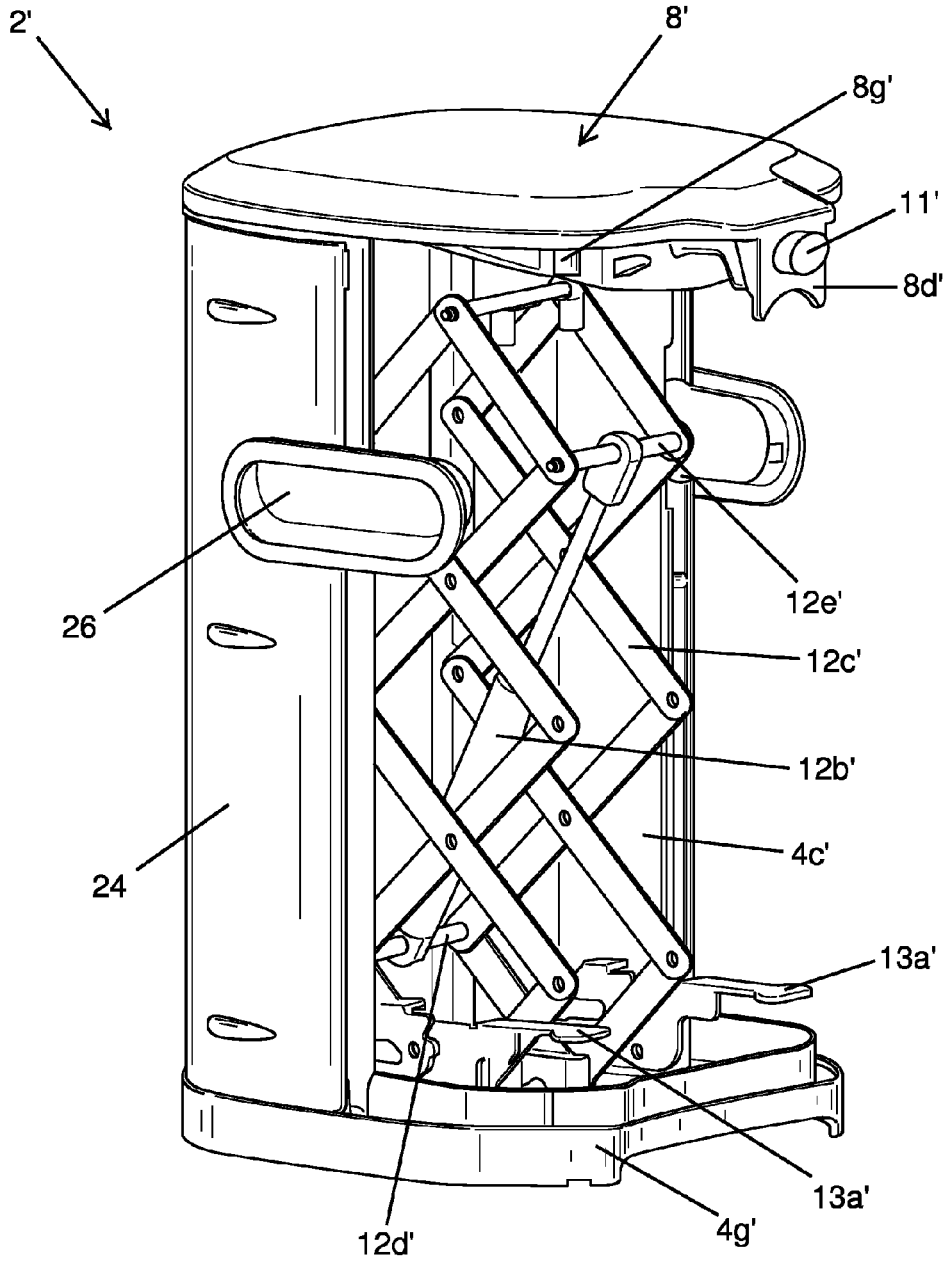
FIG. 18 shows a cutaway side perspective view of a lifter assembly arranged in a casing of a liquid dispensing system with a lifting plate removed in accordance with another preferred embodiment of the present invention.

The lifter assembly 12' also preferably includes a biasing member which is preferably defined by a piston 12*b'* (such as, for example, a compressed gas piston or a hydraulic piston, for example) and a collapsible support member, such as scissor-lift member 12*c'*, which are arranged to apply an upward biasing force to the lifting plate 10'. As shown in FIGS. 17 and 18, the collapsible scissor-lift member 12*c'* is preferably affixed to both a bottom surface of the lifting plate 10' and an upper surface of a base 4*g'* of the system 2'. The piston 12*b'* is preferably connected between a lower cross member 12*d'* and an upper cross member 12*e'* of the collapsible scissor-lift member 12*c'* to thereby apply a biasing force between the lower cross member 12*d'* and the upper cross member 12*e'*, this biasing force acting to press the lifting plate 10' upward from the base 4*g'*. However, it should be noted that the piston 12*b'* could also be affixed directly to one or more of the lifting plate 10' and the base 4*g'*, if so desired.

It is noted that the lifting plate 10' of the present preferred embodiment also preferably includes at least one engaging member 10*p'* (defined by, for example, a pin) which is arranged to engage with a retaining member 13' mounted to the upper surface of the base 4*g'*, such that, when inserting a bag of liquid into the system 2', the following procedure is preferably followed. First, the top plate assembly 8' is preferably arranged in its open position. Next, a user of the system presses the lifting plate 10' downward such that a lower lip 10*m'* of the lifting plate 10' comes into contact with the upper surface of the base 4*g'*. When the lower lip 10*m'* of the lifting plate 10' contacts the upper surface of the base 4*g'*, the engaging member 10*p'* will be retained by the retaining member 13' such that the lifting plate 10' be fixedly held in its lower position.

When the lifting plate 10' is fixedly held in its lower position, the user of the system 2' will place the bag of liquid in the cavity and position a spigot of the bag of liquid (if provided) within a spigot recess of the system 2'. Finally, the user will move the top plate assembly 8' into its fully closed position such that the spigot-recess cap 8*d'* will be positioned within the spigot recess. Once the top plate assembly 8' is positioned in its fully closed position, a lever end 13*a'* of the retaining member 13' will be actuated by, for example, a pin or spring member arranged within the front wall portion which is pressed down by a projection 8*g'* due to the closing of the top plate assembly 8' such that the retaining member 13' will release the engaging member 10*p'* such that the lifter assembly 12' will apply the upward biasing force to the bag of liquid to thereby press the liquid in the bag between the scalloped upper surface of the lifting plate 10' and a sloping convex lower surface of the pressure plate 8*a'*. Alternatively, the actuation of the retaining member 13' could be controlled in response to a closing of the latch 11', if so desired.

In other examples, lifter assemblies may include other devices for providing an upward biasing force, e.g. a piston in communication at one end with the lifting plate and with a supply of compressed fluid, e.g. air or liquid, for raising the piston; screw drives, motor lifts, etc.

In some preferred embodiments of the present invention, the liquid dispensing system includes an internal battery which is arranged to supply power to internal electrical systems, such as, for example, a motor provided in the lifter assembly, a heating and/or cooling system, etc. which are provided in the liquid dispensing system. The battery is preferably a rechargeable battery which is arranged to be recharged by removably mounting the liquid dispensing system on or in a docking station which is connected to an external power supply and which is arranged to provide power to charge the internal battery.

Figure 19:
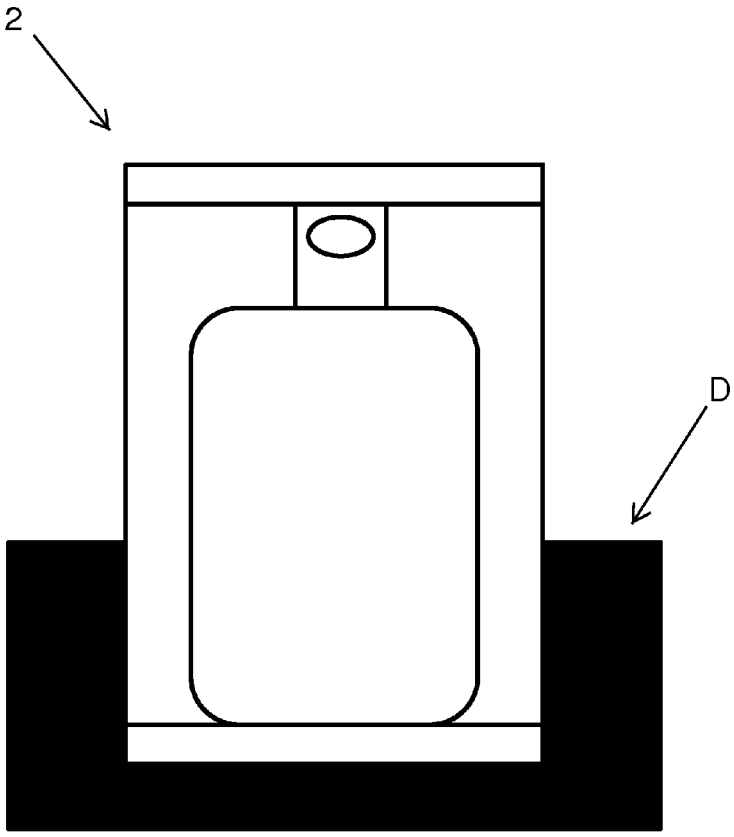
FIG. 19 shows a block diagram of a liquid dispensing system mounted in a docking station in accordance with a preferred embodiment of the present invention.

For example, FIG. 19 shows a liquid dispensing system 2 which has been mounted to a docking system D. The docking system D can preferably include electrical terminals which electrically contact electrical terminals provided on the liquid dispensing system 2 to thereby charge the internal battery of the liquid dispensing system 2. Alternatively, the docking system D could include a non-contacting charging system arranged to provide electrical power to the internal battery of the liquid dispensing system 2 through interaction between a primary transformer coil in the docking system D and a secondary transformer coil in the liquid dispensing system 2. It should be noted that it is also possible to charge the internal battery of the liquid dispensing system 2 by using devices other than the docking system D, such as, for example, an AC adaptor, a USB plug, etc.

Figure 20:
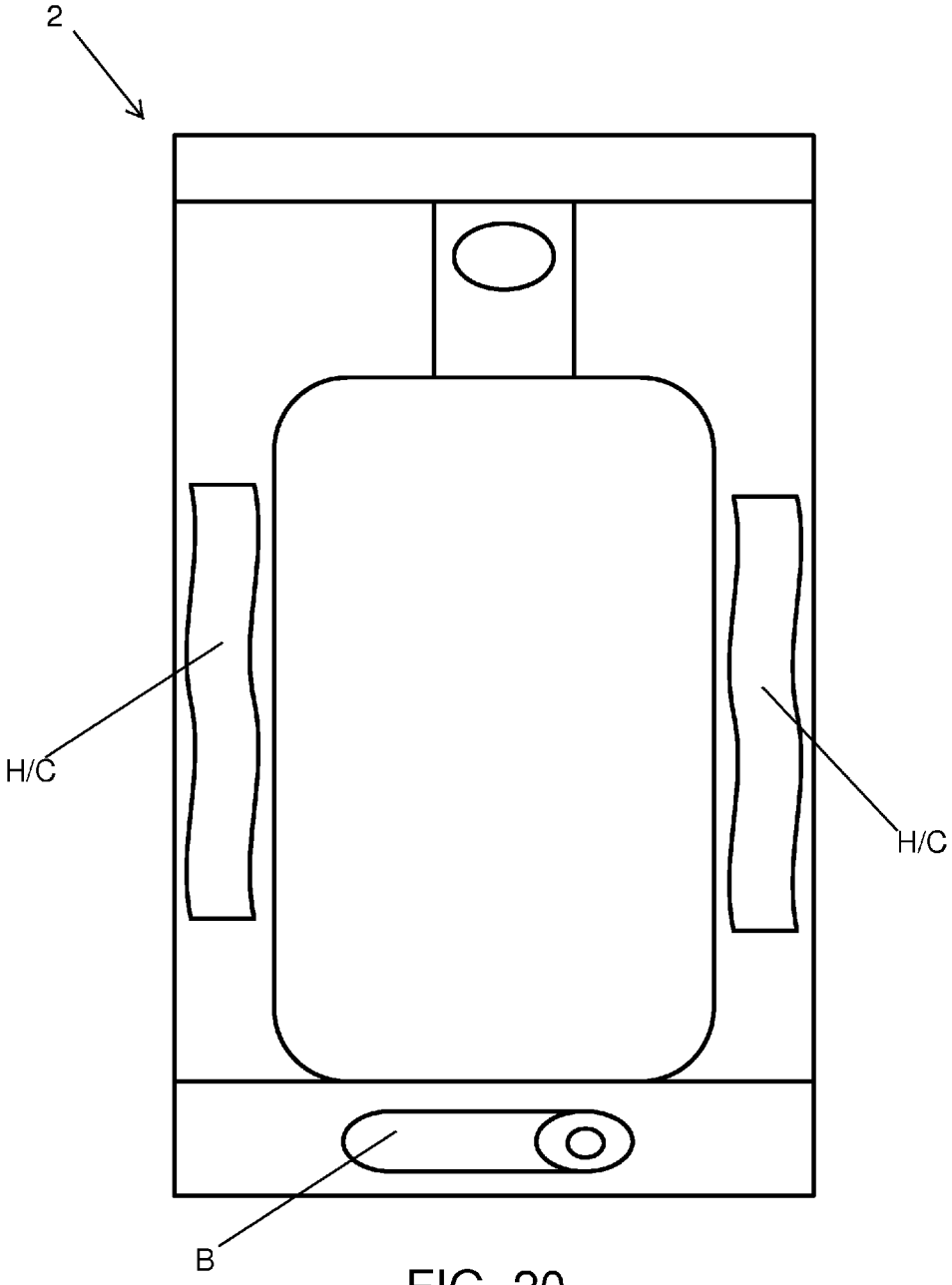
FIG. 20 shows a block diagram of a liquid dispensing system including an internal heating and/or cooling system in accordance with a preferred embodiment of the present invention.

FIG. 20 shows a block diagram of a liquid dispensing system 2 which includes an internal battery B and portions of a heating and/or cooling system H/C arranged therein. As previously discussed, the heating and/or cooling system H/C may be provided in cavities defined in the body of the liquid dispensing system 2. The heating and/or cooling system H/C is powered through an internal battery B arranged within the liquid dispensing system 2. This battery is preferably rechargeable using, for example, the docking system D discussed above.

Numerous characteristics and advantages have been set forth in the foregoing description, together with details of structure and function. The disclosure, however, is illustrative only, and changes may be made in detail, especially in matters of shape, size, and arrangement of parts, within the principle of the invention, to the full extent indicated by the broad general meaning of the terms in which the general claims are expressed.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein, and every number between the end points. For example, a stated range of "1 to 10" should be considered to include any and all sub-ranges between (and inclusive of) the minimum value of 1 and the maximum value of 10; that is, all sub-ranges beginning with a minimum value of 1 or more, e.g. 1 to 6.1, and ending with a maximum value of 10 or less, e.g., 5.5 to 10, as well as all ranges beginning and ending within the end points, e.g. 2 to 9, 3 to 8, 3 to 9, 4 to 7, and finally to each number 1, 2, 3, 4, 5, 6, 7, 8, 9 and 10 contained within the range. Additionally, any reference referred to as being "incorporated herein" is to be understood as being incorporated in its entirety.

It is further noted that, as used in this specification, the singular forms "a," "an," and "the" include plural referents unless expressly and unequivocally limited to one referent. It should also be clear that the various system examples, are not intended to be mutually exclusive, and that various parts from one example may be used in another example as described herein.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A liquid dispensing system for use with a bag of liquid including a spigot, the system comprising:

a cavity arranged to receive the bag of liquid, wherein the cavity includes a front wall;

a spigot-recess defined on the front wall of the cavity and arranged to engage the spigot, the spigot-recess being located in the front wall;

a top plate assembly arranged to be alternatingly positioned between an open position and a closed position, the top plate assembly including a pressure plate positioned at a top of the cavity, the pressure plate arranged to apply a downward force on the bag of liquid;

a lifting plate arranged to lift the bag of liquid and to apply an upward force on the bag of liquid, the lifting plate arranged to move in the cavity between a bottom-most position and a top-most position which is different from the bottom-most position;

a lifter assembly interfaced with the lifting plate, the lifter assembly arranged to guide the lifting plate to the top-most position and including at least one guide interfaced with a notch defined in an outer periphery of the lifting plate to orient a vertical ascent and descent of the lifting plate;

at least one biasing device arranged to apply a biasing force to one end to the lifting plate, the at least one biasing device including a collapsible support member;

an engaging member arranged on the lifting plate; and a retaining member arranged on a base of the cavity; wherein the retaining member is arranged to fix the lifting plate in the bottom-most position by engaging with the engaging member; and the retaining member is arranged to release the engaging member of the lifting plate when the top plate assembly is moved into the closed position.

2. The system of claim 1, wherein the at least one guide includes at least one elongated guide member extending towards a bottom surface of the cavity.

3. The system of claim 2, wherein the at least one elongated guide member includes a front pair of elongated guide members and a rear pair of elongated guide members; and the lifting plate includes a front pair of notches arranged to receive the front pair of elongated guide members and a rear pair of notches arranged to receive the rear pair of elongated guide members.

4. The system of claim 1, wherein the at least one biasing device further includes a piston and the collapsible support member is defined by a scissor lift.

5. The system of claim 1, wherein an upper surface of the lifting plate has a scalloped shape and/or a lower surface of the pressure plate includes a convex projection.

6. The system of claim 1, wherein the spigot-recess is cantilevered relative to the front wall at a distance so as to define a clearance beneath the spigot-recess, the clearance is arranged to allow a drinking glass to be positioned, at least in part, under the spigot engaged with the spigot-recess.

7. The system of claim 1, further comprising a heating and/or cooling system and an internal battery.

8. The system of claim 1, wherein the top plate assembly further includes a spigot-recess cap cantilevered relative to the front wall and configured to abut a top of the spigot-recess.

9. The system of claim 1, wherein the top plate assembly includes a hinge near the back wall of the cavity arranged to allow pivotal movement between the open position and the closed position.

10. The system of claim 1, wherein the pressure plate of the top plate assembly is vertically aligned with the lifting plate.

11. The system of claim 1, wherein the lifting plate includes a first slope including a top end and a bottom end that is lower than the top end, the top end of the first slope being positioned proximal to the back wall and the bottom end of the first slope being positioned proximal to the front wall.

12. The system of claim 11, wherein, when the lifting plate is in the top-most position, the bottom end of the first slope is positioned proximal to the spigot recess.

13. A liquid dispensing system for use with a bag of liquid including a spigot, the system comprising:

a cavity arranged to receive the bag of liquid, wherein the cavity includes a front wall;

a spigot-recess defined on the front wall of the cavity and arranged to engage the spigot, the spigot-recess being located in the front wall;

a top plate assembly arranged to be alternatingly positioned between an open position and a closed position, the top plate assembly including a pressure plate positioned at a top of the cavity, the pressure plate arranged to apply a downward force on the bag of liquid;

a lifting plate arranged to lift the bag of liquid and to apply an upward force on the bag of liquid, the lifting plate arranged to move in the cavity between a bottom-most position and a top-most position which is different from the bottom-most position;

a lifter assembly interfaced with the lifting plate, the lifter assembly arranged to guide the lifting plate to the top-most position and including at least one guide interfaced with a notch defined in an outer periphery of the lifting plate to orient a vertical ascent and descent of the lifting plate;

at least one biasing device arranged to apply a biasing force to one end to the lifting plate, the at least one biasing device including a collapsible support member; wherein the lifting plate includes a first slope including a top end and a bottom end that is lower than the top end, the top end of the first slope being positioned proximal to the back wall and the bottom end of the first slope being positioned proximal to the front wall;

when the lifting plate is in the top-most position, the bottom end of the first slope is positioned proximal to the spigot recess; and the pressure plate includes a second slope including a top end and a bottom end that is lower than the top end of the second slope, the top end of the second slope being positioned proximal to the back wall and the bottom end of the second slope being positioned proximal to the spigot-recess when the pressure plate assembly is in the closed position.

14. A liquid dispensing system for use with a bag of liquid including a spigot, the system comprising:

a cavity arranged to receive the bag of liquid, the cavity including a front wall;

a spigot-recess defined on a cantilevered portion of the front wall of the cavity and shaped to engage the spigot, the spigot-recess being located in the front wall;

a top plate assembly arranged to alternatingly pivot between an open position and a closed position, the top plate assembly including:

a pressure plate positioned at the top of the cavity, the pressure plate arranged to apply a downward force on the bag of liquid; and a spigot-recess cap cantilevered relative to the front wall at a distance such that the spigot-recess cap abuts the top of the spigot-recess;

a lifting plate arranged to lift the bag of liquid and to apply an upward force on the bag of liquid, the lifting plate arranged to move between a bottom-most position and a top-most position which is different from the bottom-most position, and the lifting plate including a first slope including a top end and a bottom end that is lower than the top end, the top end of the first slope being positioned proximal to the back wall and the bottom end of the first slope being positioned proximal to the front wall, such that, when the lifting plate is in the top-most position, the bottom end of the first slope is positioned proximal to the spigot-recess; and a lifter assembly interfaced with the lifting plate, the lifter assembly arranged to move the lifting plate to the top-most position, the lifter assembly including at least one guide interfaced with the lifting plate to orient a vertical ascent and descent of the lifting plate, and at least one biasing device arranged to apply a biasing force to one end to the lifting plate;

an engaging member arranged on the lifting plate; and a retaining member arranged on a base of the cavity; wherein the at least one biasing device includes a piston and a collapsible support member;

the at least one guide includes a front pair of elongated guide members and a rear pair of elongated guide members; and the lifting plate includes a front pair of notches arranged to receive the front pair of elongated guide members and a rear pair of notches arranged to receive the rear pair of elongated guide members;

the retaining member is arranged to fix the lifting plate in the bottom-most position by engaging with the engaging member; and the retaining member is arranged to release the engaging member of the lifting plate when the top plate assembly is moved into the closed position.

15. The system of claim 14, further including a pooling chamber positioned between the bottom end of the first slope and the spigot-recess.

16. The system of claim 14, wherein an upper surface of the lifting plate has a scalloped shape and/or a lower surface of the pressure plate includes a convex projection.

* * * * *